US008496764B2

(12) United States Patent
Luckey et al.

(10) Patent No.: US 8,496,764 B2
(45) Date of Patent: Jul. 30, 2013

(54) SYSTEM AND METHOD FOR MANUFACTURING AN F-TEMPER 7XXX SERIES ALUMINUM ALLOY

(75) Inventors: George S. Luckey, Dearborn, MI (US); Peter A. Friedman, Ann Arbor, MI (US); Yingbing Luo, Ann Arbor, MI (US); Rosa Lynda Nuno, Monroe, MI (US); Nia R Harrison, Ann Arbor, MI (US); Ronald P. Cooper, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/308,698

(22) Filed: Dec. 1, 2011

(65) Prior Publication Data

US 2012/0073347 A1 Mar. 29, 2012

(51) Int. Cl.
*C22F 1/053* (2006.01)

(52) U.S. Cl.
USPC ..... 148/697; 148/701; 148/695

(58) Field of Classification Search
USPC ..... 148/688–704; 72/342.2, 342.6, 342.5
See application file for complete search history.

(56) References Cited

U.S. PATENT DOCUMENTS

| | | | |
|---|---|---|---|
| 7,666,267 | B2 | 2/2010 | Benedictus et al. |
| 7,763,128 | B2 | 7/2010 | Heymes et al. |

FOREIGN PATENT DOCUMENTS

| | | | |
|---|---|---|---|
| EP | 0 684 883 | B1 | 4/1997 |
| WO | 98/11267 | A1 | 3/1998 |
| WO | 2009/130175 | A1 | 10/2009 |
| WO | 2010/032002 | A1 | 3/2010 |

OTHER PUBLICATIONS

"Alcoa Engineered products: Alloy 6082", Dec. 2002. www.fairdene.com/chimera/materials%20specs/alloy%206082.pdf.*

"Aluminum and Aluminum Alloys", ASM International, 1993, p. 233-235, 292.*

* cited by examiner

*Primary Examiner* — Roy King
*Assistant Examiner* — Janelle Morillo
(74) *Attorney, Agent, or Firm* — Damian Porcari; Brooks Kushman P.C.

(57) ABSTRACT

A system and a method of processing an F-temper aluminum alloy. An F-temper aluminum alloy blank may be heated and positioned in the die set such that the blank does not touch the die set. The blank may be formed into a part and quenched when the die set is closed.

16 Claims, 2 Drawing Sheets

SYSTEM AND METHOD FOR MANUFACTURING AN F-TEMPER 7XXX SERIES ALUMINUM ALLOY

TECHNICAL FIELD

This application relates to metal forming, and more specifically to forming F-temper 7xxx series aluminum alloys.

BACKGROUND

Automotive body panels have traditionally been made from mild steels. In an effort to decrease vehicle weight, aluminum alloy body panels have been increasing in popularity. The automotive and aerospace industries have focused primarily on the 5xxx and 6xxx series aluminum alloys, which are aluminum-magnesium and aluminum-magnesium-silicon alloys, respectively. The 5xxx and 6xxx series aluminum alloys may be shaped and processed by methods consistent with those of mild steel sheets.

Aluminum-zinc alloys of the 7xxx series at T6 or T7x tempers have strength similar to those of high and ultra-high strength steels and can achieve yield strengths exceeding 400 MPa. Unfortunately, T6 and T7x temper aluminum-zinc alloys cannot be conventionally stamped, as the alloys have little to no formability at room temperature.

SUMMARY

In at least one embodiment, a method of forming an F-temper aluminum alloy is provided. The method may include providing an F-temper aluminum alloy blank, heating the blank, providing a die set, positioning the blank in the die set such that the blank does not touch the die set, and closing the die set on the blank to form the blank into a part while simultaneously quenching the part.

In at least one embodiment, a method of forming an F-temper aluminum alloy into an automotive body panel is provided. The method may include heating an F-temper 7xxx series aluminum alloy material to at least its solidus temperature while cooling a die set to a temperature equal to or between 1° C. and 30° C., placing the material in the die set such that the material is spaced apart from the first die and the second die, and closing the die set on the material to form the material into the automotive body panel and simultaneously quenching the automotive body panel.

In at least one embodiment, a system for forming an F-temper aluminum alloy is provided. The system may include a die set, a heating apparatus, a transfer mechanism, a staging apparatus, and an actuator. The die set may have a first die and a second die. The heating apparatus may heat the alloy to at least its solidus temperature. The transfer mechanism may transfer the alloy from the heating apparatus to the die set. The staging apparatus may stage the alloy between and offset from the first and second dies. The actuator may actuate one or both of the first and second dies to form the alloy into a part and may simultaneously quench the part to a temperature below its solidus temperature.

DETAILED DESCRIPTION

As required, detailed embodiments of the present invention are disclosed herein; however, it is to be understood that the disclosed embodiments are merely examples and that the invention may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
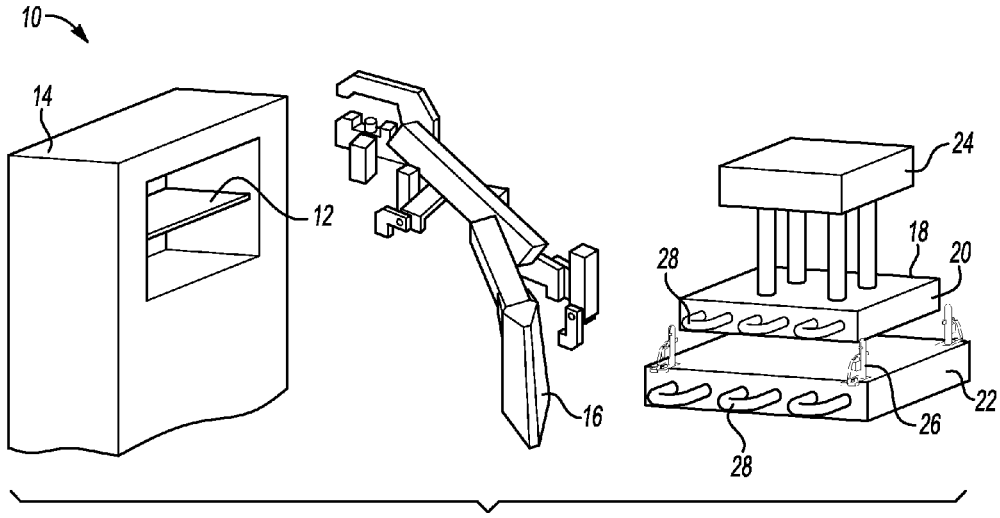
FIG. 1 is a perspective view of a system for forming an F-temper 7xxx series aluminum alloy.

Referring to FIG. 1, a system 10 for forming a blank 12 is shown. The system 10 may include a heating apparatus 14, a transfer mechanism 16, and a die set 18. In at least one embodiment, the blank 12 is an F-temper 7xxx series aluminum alloy blank 12. Aluminum alloys are identified by a four-digit number, the first digit of which generally identifies the major alloying element. For example, the major alloying element in 7xxx series aluminum is zinc while the major alloying element of 5xxx series is magnesium and for 6xxx series is magnesium and silicon. Additional numbers represented by the letter "x" in the series designation define the exact aluminum alloy. In one embodiment, a 7075 aluminum alloy may be used that has a composition of 5.1-6.1% zinc, 2.1-2.9% magnesium, 1.2-2.0% copper, and less than half a percent of silicon, iron, manganese, titanium, chromium, and other metals.

The heating apparatus 14 may be provided to heat the blank 12. The heating apparatus 14 may be an industrial furnace or oven capable of producing internal temperatures high enough to heat blanks 12 placed in the heating apparatus 14 to a predetermined temperature, such as a solution or solidus temperature of the blank 12. In at least one embodiment, the heating apparatus 14 may not heat the blank 12 past its liquidus (melting) temperature.

The solution temperature for a 7xxx series aluminum alloy may be approximately 460° C. to 490° C. The solution temperature may be the temperature at which a substance is readily miscible. Miscibility is the property of materials to mix in all proportions, forming a homogeneous solution. Miscibility may be possible in all phases; solid, liquid and gas.

The solidus temperature may be the locus of temperatures on a curve on a phase diagram below which a given substance is completely solid. The solidus temperature quantifies the temperature at which melting of a substance may begin, but not the temperature at which the substance is melted completely. With some materials there may be a phase existence between the solidus and liquidus temperatures wherein the substance consists of solid and liquid phases simultaneously. The closer the material is to the solidus temperature, the more the material is in a solid phase, and the closer the material is to the liquidus temperature, the more the material is in a liquid phase. As such, the blank 12 may be heated to at least its solidus temperature but less than its liquidus temperature, thereby providing a blank 12 that is substantially solid to facilitate handling and transport yet more readily formable due to its near liquid or partial liquid phase.

The transfer mechanism 16 may be configured to move and position the blank 12. In at least one embodiment, the transfer mechanism 16 may be a manipulator, such as a robot. The transfer mechanism 16 may be configured to quickly transfer the blank 12 from the heating apparatus 14 to the die set 18 to reduce the opportunity for heat loss from the blank 12. For example, the system 10 and transfer mechanism 16 may be configured such that the temperature of the blank 12 does not decrease to or below its critical quench temperature. The critical quench temperature is the temperature at which quenching must begin to achieve a proper quench of the material. For example, the critical quench temperature for most 7xxx series aluminum alloys is approximately 400° C.

The die set 18 may be provided to form the blank 12 into a part having a predetermined shape. In at least one embodiment, the die set 18 may include a first die 20, a second die 22, at least one actuator 24, and a staging apparatus 26.

The first and/or second dies 20, 22 may be configured to form the blank 12 into the part having a predetermined shape. An actuator 24 may actuate the first die 20 and/or the second die 22 toward or away from each other and provide force to form the blank 12. The actuator 24 may be of any suitable type, such as hydraulic, pneumatic, mechanical, electromechanical, or combinations thereof. The die set 18 and actuator 24 combination may also be referred to as a machine press, stamping press, or quenching press.

A staging apparatus 26 may be provided for positioning the blank 12 between and spaced apart from the first and second dies 20, 22. As such, the staging apparatus 26 may inhibit conductive heat transfer between the blank 12 and the die set 18, thereby helping to maintain the blank 12 at or above its critical quench temperature. The staging apparatus 26 may receive the blank 12 from the transfer mechanism 16 and may release the blank 12 as the first die 20 and/or the second die 22 are closed and engage the blank 12. In addition, the system 10 may be configured such that little heat is lost from the blank 12 between removal from the heating apparatus 14 and closing of the die set 18. In at least one embodiment, the temperature of the blank 12 may decrease by less than 10° C.; however, the blank 12 could experience a greater temperature loss, such as up to a 90° C. assuming that the blank 12 is heated to 490° C. and the critical quench temperature is 400° C.

The die set 18 may include piping 28 that facilitates cooling of the first and/or second dies 20, 22 and quenching of the part formed from the blank 12. The piping 28 may be voids or channels formed into the die set 18, or any combination of externally connected piping and channels. The piping 28 may be connected to a cooling source and may receive a heat transfer medium, such as a fluid, from the cooling source for cooling the die set 18 to a desired temperature. The heat transfer medium may be any fluid medium capable of cooling the die set 18 to a predetermined temperature range, such as from 1° C. to 30° C. The die set 18 may be cooled in a manner that inhibits formation of condensation on one or more surfaces of the die set 18. In a mass production setting, the temperature of the die set 18 may be cooled to the predetermined temperature range before forming and quenching a blank 12 to remove heat that may have been transferred from a blank 12 to the die set 18 during forming of a previous part.

Forming the heated blank 12 into a part may occur simultaneously with quenching of the part. The quench rate affects the final temper strength and corrosion performance of the material. In some embodiments, the quench rate for the aluminum alloy, as it passes from 400° C. to 290° C., may be equal to or greater than 150° C./second. The part may be further cooled to a final temperature from 200° C. to 25° C. before removal of the part from the die set 18 to provide dimensional stability during subsequent processing.

The system 10 may be designed to operate continuously with a number of blanks 12 being heated in series or parallel by one or more heating apparatuses 14 and then transferred to at least one die set 18 for forming and quenching. At least one die set may become hotter than 30° C. during, or after, the forming of the blank 12 and/or simultaneous quenching of the part, and as such more than one die set 18 may be used to provide faster production speeds.

The part may be removed from the die set 18 by the transfer mechanism 16, another transferring device, or by hand. The part then progresses on to subsequent processing which may include flanging, trimming, and a natural and/or artificial aging to bring the aluminum alloy part to a high strength temper such as T6 or T7x.

Five basic temper designations may be used for aluminum alloys which are; F- as fabricated, O- annealed, H- strain hardened, T- thermally treated, and W- as quenched (between solution heat treatment and artificial or natural aging). The temper designation may be followed by a single or double digit number for further delineation. An aluminum alloy with a T6 temper designation may be an alloy which has been solution heat treated and artificially aged, but not cold worked after the solution heat treatment (or such that cold working would not be recognizable in the material properties). T6 may represent the point of peak age yield strength along the yield strength vs. time and temperature profile for the material. A T7x temper may designate that a solution heat treatment has occurred, and that the material was artificially aged beyond the peak age yield strength (overaged) along the yield strength vs. time and temperature profile. A T7x temper material may have a lower yield strength than a T6 temper material, but this may be done to increase corrosion performance. In one embodiment, a 7xxx series aluminum alloy part with a T7x temper is formed with a yield strength maintained at or above 450 MPa.

Figure 2:
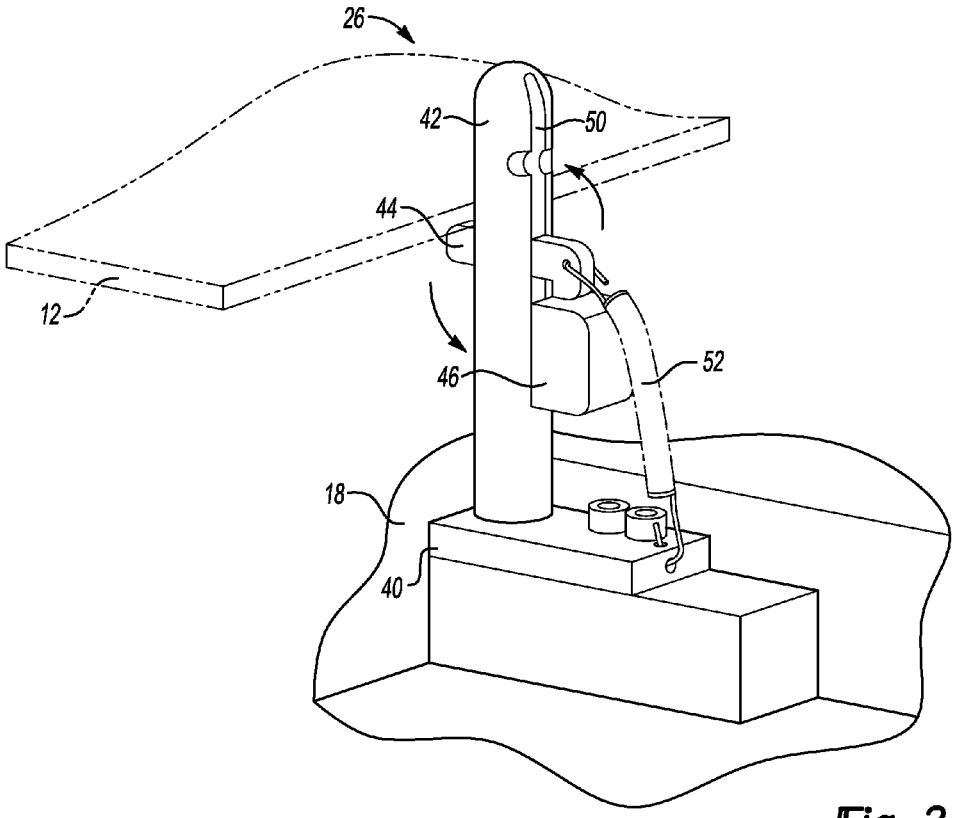
FIG. 2 is a partial perspective view of a die with a staging apparatus.

Referring to FIG. 2, an embodiment of a staging apparatus 26 is shown in more detail. One or more staging apparatuses 26 may be provided with the die set 18. For example, a staging apparatus 26 may be provided proximate a corner or side of a die in one or more embodiments. A staging apparatus 26 may be positioned or configured so as not to interfere with actuation or closing of the die set 18. Moreover, the staging apparatus 26 may help insulate or may be provided with materials that inhibit heat transfer from the blank 12 to a die. The staging apparatus 26 may include a base 40, a support member 42, a finger 44, and an actuator 46.

The base 40 may be disposed on the die set 18 and may facilitate mounting of the staging apparatus 26.

The support member 42 may extend from and may be fixedly disposed on the base 40. The support member 42 may include a slot 50. The slot 50 may be configured to receive and accommodate rotation of the finger 44.

The finger 44 may be pivotally disposed on the support member 42. For example, a pivot pin may rotatably couple the finger 44 to the support member 42 in one or more embodiments. The finger 44 may rotate between a first position and a second position. In the first position, the finger 44 may extend away from the support member 42 and may support the blank 12. The finger 44 may rotate with respect to the support member 42 and toward or into the slot 50 to a second position (as indicated by the arrows in FIG. 2) to permit the blank 12 to disengage the staging apparatus 26 and drop onto a die, such as the second die 22.

The actuator 46 may be placed in proximity of the staging apparatus and may be used to provide position control of finger 44. For example, in some embodiments the actuator 46 may be an electric motor connected to the pivot pin which rotates the finger 44 from the first position to the second position when power is applied, and a spring 52 may return the finger 44 from the second position to the first position when power is removed. The actuator 46 may be controlled by an automated control system, or by an operator. The actuator 46 may also be a servomechanism utilizing electricity, hydraulics, pneumatics, magnetic, or mechanical principles, or any combination, to provide position control of the finger 44.

Figure 3:
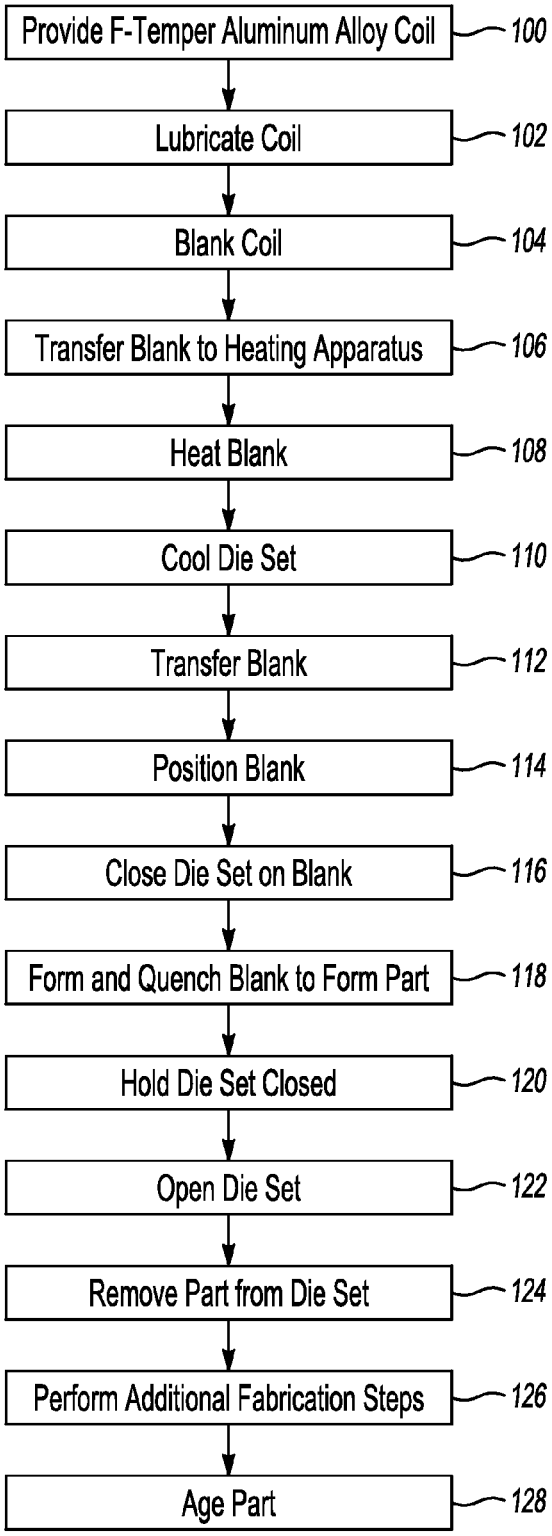
FIG. 3 is a flowchart illustrating a method of processing an F-temper 7xxx series aluminum alloy.

Referring to FIG. 3, a method of processing or forming an F-temper aluminum alloy is shown. The core steps of this method may be performed using the system 10 as described above. In one embodiment, a 7xxx series F-temper aluminum alloy is used, however it is contemplated that other series aluminum alloys could be used with the method provided that there may need to be changes to temperatures and timings to produce desired results.

At 100, the method may begin by providing an F-temper aluminum alloy coil. The F-temper aluminum alloy coil may be an "as fabricated" aluminum alloy that has had no thermal treatments or strain-hardening methods applied to the product following cold rolling of the coil as previously discussed. "As fabricated" 7xxx aluminum alloy coils are not commercially available for purchase in the market today.

At 102, the coil may be lubricated to facilitate blanking. For instance, lubrication may aid blank formation, reduce heat generation at the edges of the blank, and facilitate blank removal.

At 104, the coil may be blanked or otherwise cut into pieces to provide smaller workpieces.

At 106, one or more blanks may be transferred to the heating apparatus 14.

At 108, the one or more blanks may be heated to a desired temperature with the heating apparatus 14. The blanks may be heated to at least either its solution or solidus temperature as previously discussed. The step of heating the blank may be conducted as fast as 1 minute, or even up to 45 minutes, and still remain commercially viable.

At 110, the die set 18 may be cooled to a predetermined temperature as previously described. Cooling of the die set may occur simultaneously with one or more of the previous steps.

At 112, one or more blanks 12 may be transferred to the die set 18. For instance, a blank 12 may be transferred to the staging apparatus 26 with the transfer mechanism 16 such that the blank 12 is spaced apart from the forming surfaces of the die set 18 as previously discussed. In at least one embodiment, the transfer mechanism 16 may transfer one blank 12 from the heating apparatus 14 to one die set 18 in 30 seconds or less.

At 114, the blank 12 may be positioned in the die set 18. Positioning may occur by actuating the staging apparatus 26 from the first position to the second position to release the blank 12.

At 116, the die set 18 may be closed to form the blank 12 into a part. Closing of the die set 18 may occur after or simultaneously with releasing the blank 12 from the staging apparatus 26. In at least one embodiment, the closing of the die set 18 occurs before the blank 12 cools past a critical quench temperature as previously discussed. In at least one embodiment, the rate of closure of the first and second dies 20, 22 may be at least 50 millimeters per second to provide "quick contact" between the surfaces of the blank 12 and the die set 18 and allow for effective conductive heat transfer between the blank 12 and the die set 18 during quenching.

At 118, the die set 18 may form and quench the blank 12 into a part having a predetermined shape. Quenching may occur simultaneously with forming the blank 12 as previously discussed. Quenching may occur until the temperature of the part decreases below a predetermined temperature. A temperature sensor may be used to detect the temperature of the part or quenching may occur for a predetermined period of time. The predetermined quenching period may be determined by experimentation or by numerical approximation.

At 120, the die set 18 may be held in a closed position. The die set 18 may be held in the closed position until quenching is complete. In at least one embodiment, the die set 18 may remain closed on the part for approximately 3 to 60 seconds to ensure that the part is quenched and ready for subsequent processing. In addition, the part may be cooled to a temperature that facilitates material handling.

At 122, the die set 18 may be opened to facilitate removal of the part.

At 124, the part may be removed from the die set 18. Manual or automated material handling techniques may be employed to remove the part as previously discussed. Cooling of the die set 18 may continue during part removal in one or more embodiments.

At 126, additional manufacturing steps may be performed on the part. For instance, additional material may be removed from the part using any suitable process, such as cutting or drilling. In addition, additional forming steps may be taken, such as bending or flanging the part to provide a configuration that may not be provided with the die set 18. Such steps may be performed within a predetermined period of time, such as within 24 hours, since the part may become too brittle after that time period to allow for the additional manufacturing.

At 128, the part may be aged. Aging of the part may consist of naturally aging and/or artificially aging to achieve a high strength temper such as T6 or T7x. There are numerous aging schedules provided by ASM or MIL standards. One aging schedule that works with this method is to naturally age the part at room temperature for 24 hours followed by artificial aging the part at 120° C. for 24 hours.

The above system and methods may produce a high strength aluminum alloy part with similar strength and energy absorbing characteristics to that of high strength and ultra-high strength steels of similar geometry. High strength aluminum parts may be lighter than parts made from steel of similar geometry. Furthermore, the system and methods in this application produce high strength aluminum alloy parts at a high volume, high quality, and low cost consistent with conventional automotive metal forming. Thus a part made following the teachings of this application may replace a steel structural part with an aluminum alloy structural part without sacrificing safety and at the same time reducing overall vehicle weight. In a vehicular application, a lighter automotive part, such as a body structure component including but not limited to a rocker panel, roof rail, bumper structure, or A, B or C pillar, may reduce vehicle weight and may result in reduced fuel consumption and energy conservation.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of forming an F-temper aluminum alloy, the method comprising the steps of:

providing an F-temper 7xxx series aluminum alloy blank;

heating the blank to at least its solidus temperature;

providing a die set;

positioning the blank in the die set such that the blank does not touch the die set; and closing the die set on the blank to form the blank into a part while simultaneously quenching the part.

2. The method of claim 1 further comprising the steps of:

providing an F-temper 7xxx series aluminum alloy coil; and blanking the F-temper 7xxx series aluminum alloy coil to provide the blank, wherein the step of blanking does not materially change the temper of the 7xxx series aluminum alloy.

3. The method of claim 2 further comprising the step of:

applying a lubricant to the F-temper 7xxx series aluminum alloy coil before the step of blanking the F-temper 7xxx series aluminum alloy coil.

4. The method of claim 1 wherein the step of heating the blank is performed outside of the die set, and the method further comprises the step of transferring the blank to the die set after the step of heating the blank and before the step of positioning the blank, wherein the steps of transferring the blank to the die set and positioning the blank in the die set is performed in 30 seconds or less.

5. The method of claim 1 wherein the step of closing the die set on the blank is done at a rate of at least 50 millimeters per second.

6. The method of claim 1 wherein the heat loss from the blank between the steps of heating the blank and closing the die set on the blank is such that the blank is maintained at or above a critical quench temperature.

7. The method of claim 1 further comprising the step of:

cooling the die set to a temperature equal to or between 1° C. and 30° C. before the step of closing the die set on the blank.

8. The method of claim 1 further comprising the steps of:

holding the die set closed on the blank for 3 to 60 seconds after the step of closing the die set on the blank.

9. The method of claim 1 wherein quenching the part includes cooling the part at a quench rate of at least 150° C./second.

10. The method of claim 1 further comprising the step of:

artificially aging the part to achieve a high strength temper.

11. The method of claim 1 further comprising the step of:

aging the part to achieve a T6 or T7x temper aluminum part.

12. A method of forming an F-temper aluminum alloy into an automotive body panel, the method comprising the steps of:

heating an F-temper 7xxx series aluminum alloy material to at least its solidus temperature while cooling a die set having a first die and a second die to a temperature equal to or between 1° C. and 30° C.;

placing the material in the die set such that the material is spaced apart from the first die and the second die; and closing the die set on the material to form the material into the automotive body panel and simultaneously quenching the automotive body panel.

13. The method of claim 12, further comprising the step of:

providing a staging apparatus to hold the material between and apart from the die set and to release the material to engage the second die as the die set closes.

14. A method of forming an aluminum alloy, the method comprising the steps of:

providing an aluminum alloy blank;

heating the blank to at least its solidus temperature;

providing a die set;

positioning the blank in the die set; and closing the die set on the blank to form the blank into a part while simultaneously quenching the part.

15. The method of claim 14 wherein during the step of positioning the blank in the die set, positioning the blank such that the blank does not contact the die set until the step of closing the die set on the blank.

16. The method of claim 14 further comprising the step of cooling the die set.

* * * * *